US011292982B2

(12) United States Patent
Hartley et al.

(10) Patent No.: US 11,292,982 B2
(45) Date of Patent: Apr. 5, 2022

(54) METHOD FOR LUBRICATING SURFACES

(71) Applicant: Infineum International Limited, Abingdon (GB)

(72) Inventors: Joseph P. Hartley, Oxford (GB); Emmanuel Laine, Maidenhead (GB); Gregory O. E. Stidder, Wantage (GB)

(73) Assignee: Infineum International Ltd

( * ) Notice: Subject to any disclaimer, the term of this patent is extended or adjusted under 35 U.S.C. 154(b) by 220 days.

(21) Appl. No.: 15/913,161

(22) Filed: Mar. 6, 2018

(65) Prior Publication Data

US 2018/0258364 A1 Sep. 13, 2018

(30) Foreign Application Priority Data

Mar. 7, 2017 (EP) ..... 17159632

(51) Int. Cl.

| | |
|---|---|
| ***C10M 135/18*** | (2006.01) |
| ***C10M 163/00*** | (2006.01) |
| ***C10M 145/02*** | (2006.01) |
| ***C10M 161/00*** | (2006.01) |
| ***C10M 169/04*** | (2006.01) |
| *C10N 10/12* | (2006.01) |
| *C10N 30/06* | (2006.01) |
| *C10N 40/25* | (2006.01) |

(52) U.S. Cl.

CPC ..... *C10M 135/18* (2013.01); *C10M 145/02* (2013.01); *C10M 161/00* (2013.01); *C10M 163/00* (2013.01); *C10M 169/044* (2013.01); *C10M 2207/288* (2013.01); *C10M 2209/02* (2013.01); *C10M 2209/104* (2013.01); *C10M 2209/109* (2013.01); *C10M 2219/068* (2013.01); *C10M 2223/045* (2013.01); *C10N 2010/12* (2013.01); *C10N 2030/06* (2013.01); *C10N 2040/25* (2013.01)

(58) Field of Classification Search

CPC ..... C10M 135/18; C10M 145/24; C10M 145/26; C10M 163/00; C10M 145/02; C10M 161/00; C10M 169/044; C10M 2209/104; C10M 2207/288; C10M 2223/045; C10M 2209/109; C10M 2209/02; C10M 2219/068; C10M 169/045; C10M 169/048; C10M 2207/289; C10M 2207/026; C10M 2219/08; C10M 2219/044; C10M 2215/223; C10M 2215/064; C10M 2203/1025; C10N 2010/12; C10N 2030/06; C10N 2040/25; C10N 2020/02; F16H 57/04

USPC ..... 508/363, 494

See application file for complete search history.

(56) References Cited

U.S. PATENT DOCUMENTS

| | | | | |
|---|---|---|---|---|
| 7,458,585 | B2 * | 12/2008 | Hamada | C10M 141/10 277/310 |
| 8,846,590 | B2 * | 9/2014 | Castle | C10M 135/18 123/1 A |
| 2005/0119136 | A1 * | 6/2005 | Castle | C10M 135/18 508/363 |
| 2006/0263604 | A1 | 11/2006 | Martin et al. | |
| 2015/0018254 | A1 * | 1/2015 | Araujo | C23C 28/341 508/105 |
| 2015/0344810 | A1 | 12/2015 | Strong et al. | |
| 2015/0344811 | A1 * | 12/2015 | Strong | C10M 161/00 508/306 |
| 2015/0344812 | A1 | 12/2015 | Strong et al. | |
| 2015/0344813 | A1 | 12/2015 | Strong et al. | |

FOREIGN PATENT DOCUMENTS

| | | | |
|---|---|---|---|
| EP | 1338541 | A1 | 8/2003 |
| WO | WO 2011/107739 | A1 | 9/2011 |
| WO | 2015065801 | A1 | 5/2015 |
| WO | 2015193395 | A1 | 12/2015 |

OTHER PUBLICATIONS

Lube-Tech, Friction Modifiers for Next Generation Engine Oils, Lube Magazine, No. 120, Apr. 2014, pp. 27-34.

Croda Europe Limited, The Use of Perfad 3006 as a Polymeric Friction Modifier in Automotive Engine Oil Formulations, Research Disclosure Questel Ireland Ltd., RD 632021, Dec. 2016 3/9.

I. Sugimoto, Wear Mechanisms Specific to DLC in Oil Containing Mo-DTC, Transactions of the Japan Society of Mechanical Engineers, Series A, vol. 78 No. 786 (Feb. 2012), pp. 213-222.

I. Sugimoto, Wear Mechanisms Specific to DLC in Oil Containing Mo-DTC, Transactions of the Japan Society of Mechanical Engineers, Series A, vol. 78 No. 786 (Feb. 2012), pp. 213-222. [English Translation].

* cited by examiner

*Primary Examiner* — Prem C Singh
*Assistant Examiner* — Francis C Campanell

(57) ABSTRACT

A method of lubricating the contact between a first surface coated with a hydrogenous carbon film or coating of type a-C:H, ta-C:H, a-C:H:Me or a-C:H:X, as classified by VDI-Standard VDI 2840 and a second ferrous, preferably steel surface. The method comprises supplying to said contact a lubricating oil composition comprising a major amount of an oil of lubricating viscosity and (a) an oil-soluble or oil-dispersible molybdenum compound in an amount such as to provide between 150 and 1000 ppm by weight of molybdenum to the lubricating oil composition, and (b) between 0.1 and 5% by weight with respect to the weight of the lubricating oil composition of a polymeric organic friction modifier, the organic friction modifier being the reaction product of (i) a functionalised polyolefin, (ii) a polyether, (iii) a polyol and (iv) a monocarboxylic acid chain terminating group.

23 Claims, No Drawings

METHOD FOR LUBRICATING SURFACES

This invention relates to methods for lubricating surfaces coated with diamond-like carbon (DLC) films or coatings which are in contact with ferrous, preferably steel surfaces.

Diamond-like carbon hereinafter (DLC), is a generic term commonly used to describe a wide range of amorphous carbon materials. The materials are usually provided in the form of a film or coating and are characterised in that they have mechanical properties, such as hardness, which resemble, but do not duplicate, those of diamond. DLC can either be hydrogenated or non-hydrogenated and are commonly prepared using PVD or CVD techniques. In addition to carbon (and hydrogen in the case of hydrogenated DLC), DLC may also incorporate other chemical elements such as nitrogen, silicon or fluorine or metal dopants. Metals are more commonly used than other elements with metals such as tungsten and titanium being the most common. DLC films and coatings can have high hardness (about 3 to 22 GPa), low roughness, low dry friction coefficients and transparency across a major portion of the electromagnetic spectrum. In general, DLC films and coatings include a wide range of amorphous carbon materials where at least some of the carbon atoms are bonded in chemical structures similar to those of diamond, but without the long-range crystal order of diamond. The Association of German Engineers (VDI) has devised a classification system for DLC films which organises the various types of film on the basis of their physical and chemical properties. This is published as VDI-Standard VDI 2840 and provides a uniform classification and nomenclature such that the various types of DLC film can be unambiguously identified. VDI 2840 identifies seven types of DLC film:

- Hydrogen-free amorphous carbon films, designated a-C
- Tetrahedral, hydrogen-free amorphous carbon films, designated ta-C
- Metal-containing, hydrogen-free amorphous carbon films, designated a-C:Me
- Hydrogenous amorphous carbon films, designated a-C:H
- Tetrahedral, hydrogenous amorphous carbon films, designated ta-C:H
- Metal-containing, hydrogenous amorphous carbon films, designated a-C:H:Me
- Modified hydrogenous amorphous carbon films, designated a-C:H:X The tetrahedral films have higher levels of $sp^3$ carbon linkages compared to the other types where $sp^2$ carbon linkages are more prevalent. Metal dopants (represented by Me) include tungsten, titanium and similar and X in the modified structures may be nitrogen, silicon, boron and similar. Hydrogenated films commonly contain up to 50 atomic percent of hydrogen and will usually contain at least 5 atomic percent of hydrogen.

Many methods for directly depositing DLC films or coatings are known in the art, including (i) direct ion beam deposition, dual ion beam deposition, glow discharge, radio frequency (RF) plasmas, direct current (DC) plasma or microwave plasma deposition from a carbon-containing gas or vapour which can also be mixed with hydrogen and/or inert gas and/or other gases containing doping elements, (ii) electron beam evaporation, ion-assisted evaporation, magnetron sputtering, ion beam sputtering, or ion-assisted sputter deposition from a solid carbon or doped carbon target material, or (iii) combinations of (i) and (ii).

The use of such DLC films in coating the components of internal combustion engines is described, for example, in U.S. Pat. No. 5,771,873.

It is common to use oil-soluble or oil-dispersible molybdenum compounds in lubricating oil compositions to reduce friction and provide wear protection to engine parts where steel-on-steel contact occurs. Both dinuclear molybdenum compounds (i.e. compounds containing two molybdenum atoms) and trinuclear molybdenum compounds (i.e. compounds containing three molybdenum atoms) provide substantial benefits. It is also known for example from EP 1 426 508 A1 that both dinuclear and trinuclear molybdenum compounds provide friction reduction in DLC-to-DLC contacts. However, in many engines, there are parts made from ferrous materials (commonly steels) which are in contact with parts which carry a DLC film or coating. Studies have shown (see for example, I Sugimoto, *Transactions of the Japan Society of Mechanical Engineers, Series A*, Vol. 78, No. 786, pp. 213-222) that oil-soluble molybdenum compounds display different behaviour in DLC-to-steel contacts whereby the DLC coated surface is worn at a higher rate that its mating steel surface and to an extent which is not observed when the mating surface is another DLC coated surface.

The present invention is based on the discovery that the contact between a surface carrying a particular type of DLC film or coating and a ferrous, preferably steel surface, can be effectively lubricated by employing a lubricating oil composition containing a combination of an oil-soluble or oil-dispersible molybdenum compound and a particular type of organic friction modifier. The present invention thus utilises the friction reducing properties provided by the molybdenum compound without compromising the wear protection afforded by the lubricating oil composition. It is noteworthy that the wear behaviour addressed by the present invention is evident for some, but not all, of the DLC coating types from the VDI 2840 classification system.

Accordingly in a first aspect, the present invention provides a method of lubricating the contact between a first surface coated with a hydrogenous carbon film or coating of type a-C:H, ta-C:H, a-C:H:Me or a-C:H:X, as classified by VDI-Standard VDI 2840, and a second ferrous, preferably steel surface which method comprises supplying to said contact a lubricating oil composition comprising a major amount of an oil of lubricating viscosity and (a) an oil-soluble or oil-dispersible molybdenum compound in an amount such as to provide between 150 and 1000 ppm by weight of molybdenum to the lubricating oil composition, and (b) between 0.1 and 5% by weight with respect to the weight of the lubricating oil composition of a polymeric organic friction modifier, the organic friction modifier being the reaction product of (i) a functionalised polyolefin, (ii) a polyether, (iii) a polyol and (iv) a monocarboxylic acid chain terminating group.

In a second aspect, the present invention provides an internal combustion engine having one or more component parts coated with a hydrogenous carbon film or coating of type a-C:H, ta-C:H, a-C:H:Me or a-C:H:X, as classified by VDI-Standard VDI 2840, which parts during operation of the engine, are in contact with a ferrous, preferably steel surface and, contained in a reservoir in the engine, a lubricating oil composition comprising a major amount of an oil of lubricating viscosity and (a) an oil-soluble or oil-dispersible molybdenum compound in an amount such as to provide between 150 and 1000 ppm by weight of molybdenum to the lubricating oil composition, and (b) between 0.1 and 5% by weight with respect to the weight of the lubricating oil composition of a polymeric organic friction modifier, the organic friction modifier being the reaction product of (i) a functionalised polyolefin, (ii) a polyether, (iii) a polyol and (iv) a monocarboxylic acid chain terminating group.

The reservoir in the engine may be a crankcase sump in four-stroke engines, from where it is distributed around the engine for lubrication. The invention is applicable to two-stroke and four-stroke spark-ignited and compression-ignited engines.

In a third aspect, the present invention provides the use of a lubricating oil composition comprising a major amount of an oil of lubricating viscosity and (a) an oil-soluble or oil-dispersible molybdenum compound in an amount such as to provide between 150 and 1000 ppm by weight of molybdenum to the lubricating oil composition, and (b) between 0.1 and 5% by weight with respect to the weight of the lubricating oil composition of a polymeric organic friction modifier, the organic friction modifier being the reaction product of (i) a functionalised polyolefin, (ii) a polyether, (iii) a polyol and (iv) a monocarboxylic acid chain terminating group to lubricate an internal combustion engine having one or more component parts coated with a hydrogenous carbon film or coating of type a-C:H, ta-C:H, a-C:H:Me or a-C:H:X, as classified by VDI-Standard VDI 2840, which parts during operation of the engine, are in contact with a ferrous, preferably steel surface.

In a fourth aspect, the invention provides the use of a lubricating oil composition comprising a major amount of an oil of lubricating viscosity and (a) an oil-soluble or oil-dispersible molybdenum compound in an amount such as to provide between 150 and 1000 ppm by weight of molybdenum to the lubricating oil composition, and (b) between 0.1 and 5% by weight with respect to the weight of the lubricating oil composition of a polymeric organic friction modifier, the organic friction modifier being the reaction product of (i) a functionalised polyolefin, (ii) a polyether, (iii) a polyol and (iv) a monocarboxylic acid chain terminating group to reduce friction and prevent wear between one or more component parts of an internal combustion engine, which parts are coated with a hydrogenous carbon film or coating of type a-C:H, ta-C:H, a-C:H:Me or a-C:H:X, as classified by VDI-Standard VDI 2840, and one or more component parts of the combustion engine having a ferrous, preferably steel surface.

Preferably, the oil-soluble or oil-dispersible molybdenum compound (a) is present in an amount such as to provide between 300 and 1000 ppm, preferably 400 and 1000 ppm by weight of molybdenum to the lubricating oil composition, for example between 500 and 1000 ppm. The molybdenum content of the lubricating oil composition is as determined by ASTM D5185.

As described in more detail below, the oil-soluble or oil-dispersible molybdenum compound (a) may be a mixture of two or more molybdenum compounds and in a preferred embodiment, the oil-soluble or oil-dispersible molybdenum compound (a) is a mixture of two or more molybdenum compounds. In these instances, the amounts of molybdenum in the lubricating oil composition referred to herein are the combined total amounts of molybdenum contributed by the mixture of compounds.

Preferably, the oil-soluble or oil-dispersible molybdenum compound (a) comprises one or more of a molybdenum dithiocarbamate, a molybdenum dithiophosphate, a molybdenum dithiophosphinate, a molybdenum xanthate, a molybdenum thioxanthate or a molybdenum sulfide. In a preferred embodiment, the oil-soluble or oil-dispersible molybdenum compound comprises one or more molybdenum dithiocarbamates. Most preferred are di-nuclear and tri-nuclear molybdenum dithiocarbamates. In an embodiment, the oil-soluble or oil-dispersible molybdenum compound comprises one or more di-nuclear molybdenum dithiocarbamates. In another embodiment, the oil-soluble or oil-dispersible molybdenum compound comprises one or more tri-nuclear molybdenum dithiocarbamates. In a yet further embodiment, the oil-soluble or oil-dispersible molybdenum compound comprises a mixture of one or more di-nuclear molybdenum dithiocarbamates and one or more tri-nuclear molybdenum dithiocarbamates. These molybdenum compounds are described in further detail hereinbelow.

This invention is especially applicable to the lubrication of spark-ignited or compression-ignited two-stroke or four-stroke internal combustion engines which have parts or components with DLC films or coatings which are in contact with parts or components having ferrous, preferably steel surfaces. Examples of such parts and components include the cam shaft, especially the cam lobes; pistons, especially the piston skirt; cylinder liners; and valves.

The various features of the invention, which are applicable to all aspects, are described in more detail below.

(a) Oil-Soluble or Oil-Dispersible Molybdenum Compound

As examples of oil-soluble or oil-dispersible molybdenum compounds (a), there may be mentioned dithiocarbamates, dithiophosphates, dithiophosphinates, xanthates, thioxanthates and sulfides of molybdenum and mixtures thereof.

Additionally, the molybdenum compounds may be acidic molybdenum compounds. These compounds will react with a basic nitrogen compound as measured by ASTM test D-664 or D-2896 titration procedure and are typically hexavalent. Included are molybdic acid, ammonium molybdate, sodium molybdate, potassium molybdate, and other alkaline metal molybdates and other molybdenum salts, e.g., hydrogen sodium molybdate, $MoOCl_4$, $MoO_2Br$, $Mo_2O_3Cl_6$, molybdenum trioxide or similar acidic molybdenum compounds.

Among the molybdenum compounds useful in this invention are organo-molybdenum compounds of the formulae:

$Mo(ROCS_2)_4$ and $Mo(RSCS_2)_4$ wherein R is an organo group selected from the group consisting of alkyl, aryl, aralkyl and alkoxyalkyl, generally of from 1 to 30 carbon atoms, and preferably 2 to 12 carbon atoms and most preferably alkyl of 2 to 12 carbon atoms. Especially preferred are dialkyldithiocarbamates of molybdenum.

A further class of oil-soluble or oil-dispersible molybdenum compounds are di-nuclear molybdenum compounds. Examples are represented by the formula:

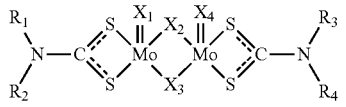

where $R_1$ to $R_4$ independently denote a straight chain, branched chain or aromatic hydrocarbyl group having 1 to 24 carbon atoms; and $X_1$ to $X_4$ independently denote an oxygen atom or a sulfur atom. The four hydrocarbyl groups, $R_1$ to $R_4$, may be identical or different from one another.

Another group of oil-soluble or oil-dispersible molybdenum compounds useful in this invention are trinuclear molybdenum compounds, especially those of the formula $Mo_3S_kL_nQ_z$ and mixtures thereof wherein the L are independently selected ligands having organo groups with a sufficient number of carbon atoms to render the compound soluble or dispersible in the oil, n is from 1 to 4, k varies from 4 through 7, Q is selected from the group of neutral electron donating compounds such as water, amines, alcohols, phosphines, and ethers, and z ranges from 0 to 5 and includes non-stoichiometric values. In the instance n is 3, 2 or 1, appropriately charged ionic species is required to confer electrical neutrality to the trinuclear molybdenum compound. The ionic species may be of any valence, for example, monovalent or divalent. Further the ionic species may be negatively charged, i.e. an anionic species, or may be positively charged, i.e. a cationic species or a combination of an anion and a cation. Such terms are known to a skilled person in the art. The ionic species may be present in the compound through covalent bonding, i.e. coordinated to one or more molybdenum atoms in the core, or through electrostatic bonding or interaction as in the case of a counter-ion or through a form of bonding intermediate between covalent and electrostatic bonding. Examples of anionic species include disulfide, hydroxide, an alkoxide, an amide and a thiocyanate or derivate thereof; preferably the anionic species is disulfide ion. Examples of cationic species include an ammonium ion and a metal ion, such as an alkali metal, alkaline earth metal or transition metal, ion, preferably an ammonium ion, such as $[NR_4]^+$ where R is independently H or alkyl group, more preferably R is H, i.e. $[NH_4]^+$. At least 21 total carbon atoms should be present among all the ligands' organo groups, such as at least 25, at least 30, or at least 35 carbon atoms.

The ligands are independently selected from the group of

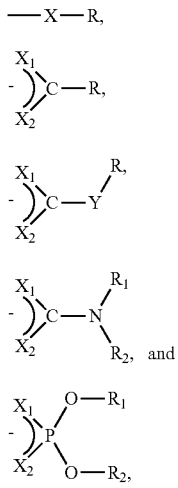

and mixtures thereof, wherein X, $X_1$, $X_2$, and Y are independently selected from the group of oxygen and sulfur, and wherein $R_1$, $R_2$, and R are independently selected from hydrogen and organo groups that may be the same or different. Preferably, the organo groups are hydrocarbyl groups such as alkyl (e.g., in which the carbon atom attached to the remainder of the ligand is primary or secondary), aryl, substituted aryl and ether groups. More preferably, each ligand has the same hydrocarbyl group.

The term "hydrocarbyl" denotes a substituent having carbon atoms directly attached to the remainder of the ligand and is predominantly hydrocarbyl in character within the context of this invention. Such substituents include: hydrocarbon substituents, that is, aliphatic (for example alkyl or alkenyl), alicyclic (for example cycloalkyl or cycloalkenyl) substituents, aromatic-, aliphatic- and alicyclic-substituted aromatic nuclei and the like, as well as cyclic substituents wherein the ring is completed through another portion of the ligand (that is, any two indicated substituents may together form an alicyclic group); substituted hydrocarbon substituents, that is, those containing non-hydrocarbon groups which, in the context of this invention, do not alter the predominantly hydrocarbyl character of the substituent. Those skilled in the art will be aware of suitable groups (e.g., halo, especially chloro and fluoro, amino, alkoxyl, mercapto, alkylmercapto, nitro, nitroso and sulfoxy); and hetero substituents, that is substituents which, while predominantly hydrocarbon in character within the context of this invention, contain atoms other than carbon present in a chain or ring otherwise composed of carbon atoms.

Importantly, the organo groups of the ligands have a sufficient number of carbon atoms to render the compound soluble or dispersible in the oil. For example, the number of carbon atoms in each group will generally range between 1 to 100, preferably from 1 to 30, and more preferably between 4 to 20. Preferred ligands include dialkyldithiophosphate, alkylxanthate, and dialkyldithiocarbamate, and of these dialkyldithiocarbamate is more preferred. Organic ligands containing two or more of the above functionalities are also capable of serving as ligands and binding to one or more of the cores. Those skilled in the art will realize that formation of the compounds useful in the present invention requires selection of ligands having the appropriate charge to balance the core's charge.

Compounds having the formula $Mo_3S_kL_nQ_z$ have cationic cores surrounded by anionic ligands and are represented by structures such as

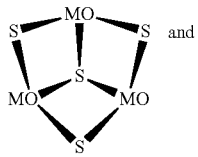

and

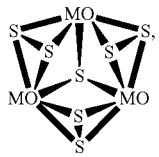

and have net charges of +4. Consequently, in order to solubilize these cores the total charge among all the ligands must be −4. Four monoanionic ligands are preferred. Without wishing to be bound by any theory, it is believed that two or more trinuclear cores may be bound or interconnected by means of one or more ligands and the ligands may be multidentate. Such structures fall within the scope of this invention. This includes the case of a multidentate ligand having multiple connections to a single core. It is believed that oxygen and/or selenium may be substituted for sulfur in the core(s).

Oil-soluble or oil-dispersible trinuclear molybdenum compounds can be prepared by reacting in the appropriate liquid(s) and/or solvent(s) a molybdenum source such as $(NH_4)_2Mo_3S_{13}.n(H_2O)$, where n varies between 0 and 2 and includes non-stoichiometric values, with a suitable ligand source such as a tetralkylthiuram disulfide. Other oil-soluble or oil-dispersible trinuclear molybdenum compounds can be formed during a reaction in the appropriate solvent(s) of a molybdenum source such as of $(NH_4)_2Mo_3S_{13}.n(H_2O)$, a ligand source such as tetralkylthiuram disulfide, dialkyldithiocarbamate, or dialkyldithiophosphate, and a sulfur-abstracting agent such cyanide ions, sulfite ions, or substituted phosphines. Alternatively, a trinuclear molybdenum-sulfur halide salt such as $[M']_2[Mo_3S_7A_6]$, where M' is a counter ion, and A is a halogen such as Cl, Br, or I, may be reacted with a ligand source such as a dialkyldithiocarbamate or dialkyldithiophosphate in the appropriate liquid(s) and/or solvent(s) to form an oil-soluble or oil-dispersible trinuclear molybdenum compound. The appropriate liquid and/or solvent may be, for example, aqueous or organic.

The oil solubility or dispersibility of a compound may be influenced by the number of carbon atoms in the organo groups of the attached ligands. In the compounds employed in the present invention, at least 21 total carbon atoms should be present among all the ligand's organo groups. Preferably, the ligand source chosen has a sufficient number of carbon atoms in its organo groups to render the compound soluble or dispersible in the lubricating composition.

The oil-soluble or oil-dispersible molybdenum compound is preferably an organo-molybdenum compound. Moreover, the molybdenum compound is preferably selected from the group consisting of a molybdenum dithiocarbamate (MoDTC), molybdenum dithiophosphate, molybdenum dithiophosphinate, molybdenum xanthate, molybdenum thioxanthate, molybdenum sulfide and mixtures thereof.

Most preferably, the oil-soluble or oil-dispersible molybdenum compound comprises one or more molybdenum dithiocarbamates. In preferred embodiments, the oil-soluble or oil-dispersible molybdenum compound comprises one or more di-nuclear molybdenum dithiocarbamates or comprises one or more tri-nuclear molybdenum dithiocarbamates.

In a most preferred embodiment, the oil-soluble or oil-dispersible molybdenum compound comprises a mixture of one or more di-nuclear molybdenum dithiocarbamates and one or more tri-nuclear molybdenum dithiocarbamates. In this embodiment, the ratio of di-nuclear molybdenum dithiocarbamate to tri-nuclear molybdenum dithiocarbamate, in terms of the weight of molybdenum contributed to the lubricating oil composition by each type of molybdenum compound, is from 1:9 to 9:1, preferably 1:4 to 4:1, more preferably 1:2 to 2:1, for example 1:1. As discussed above, in this embodiment, the amounts of molybdenum in the lubricating oil composition referred to herein are the combined total amounts of molybdenum contributed by the mixture of compounds.

(b) Polymeric Organic Friction Modifier

As with all polymers, the polymeric organic friction modifier (b) useful in the present invention will comprise a mixture of molecules of various sizes. Suitably, the majority of the molecules have a molecular weight in the range of 1,000 to 30,000 Daltons.

The functionalised polyolefin (i) is preferably derived from a polymer of a monoolefin having from 2 to 6 carbon atoms, such as ethylene, propylene, butene and isobutene. The functionalised polyolefin of the present invention suitably contains a chain of from 15 to 500, preferably 50 to 200 carbon atoms. Preferably, the polymer of a monoolefin is a polyisobutene polymer or a derivative thereof.

The functionalised polyolefin (i) may comprise a diacid or anhydride functional group from reaction of the polyolefin with an unsaturated diacid or anhydride. The functionalised polyolefin is suitably functionalised by reaction with maleic anhydride.

In a preferred embodiment, the functionalised polyolefin (i) is a polyisobutylene polymer that has been reacted with maleic anhydride to form polyisobutylene succinic anhydride (PIBSA). Suitably, the PIBSA has a molecular weight in the range of 300-5000 Da, preferably 500-1500 Da and especially 800 to 1200 Da. PIBSA is a commercially available compound made from the addition reaction of polyisobutylene having a terminal unsaturated group and maleic anhydride.

Alternatively, the functionalised polyolefin (i) may be functionalised by an epoxidation reaction with a peracid, for example perbenzoic acid or peracetic acid.

The polyether (ii) may comprise, for example, polyglycerol or polyalkylene glycol. In a preferred embodiment the polyether is a water soluble alkylene glycol, such as polyethylene glycol (PEG). Suitably the PEG has a molecular weight in the range of 300-5000 Da, more preferably 400-1000 Da and particularly 400 to 800 Da. In a preferred embodiment the polyether is $PEG_{400}$, $PEG_{600}$ or $PEG_{1000}$. Alternatively, a mixed poly(ethylene-propylene) glycol or a mixed poly(ethylene-butylene) glycol may be used. Alternatively, the polyether may be derived from a diol or a diamine containing acidic groups, for example, carboxylic acid groups, sulphonyl groups (e.g. sulphonyl styrenic groups), amine groups (e.g. tetraethylene pentamine or polyethylene imine) or hydroxyl groups.

The polyether (ii) suitably has a molecular weight of 300-5,000 Da, more preferably 400-1,000 Da or 400-800 Da.

The functionalised polyolefin (i) and the polyether (ii) may form block copolymer units.

The functionalised polyolefin (i) and the polyether (ii) may be linked directly to one another and/or they may be linked together by a backbone moiety.

The polyol reactant (iii) of the polymeric friction modifier useful in the present invention suitably provides a backbone moiety capable of linking together the functionalised polyolefin (i) and polyether (ii) reactants. The polyol may comprise a diol, triol, tetraol, or related dimers or trimers or higher oligomers of such compounds. Suitable polyols include glycerol, neopentyl glycol, trimethylolethane, trimethylolpropane, trimethylolbutane, pentaerythritol, dipentaerythritol, tripentaerythritol and sorbitol. In a preferred embodiment the polyol (iii) is glycerol.

The polymeric friction modifier useful in the present invention comprises monocarboxylic acid chain terminating group (iv). Any carboxylic acid is suitable as a chain terminating group. Suitable examples include $C_{2-36}$ carboxylic acids, preferably $C_{6-30}$ carboxylic acids and more preferably, $C_{12-22}$ carboxylic acids. The carboxylic acids may be linear or branched, saturated or unsaturated. In preferred embodiments the carboxylic acid chain terminating group (iv) comprises on or more of lauric acid, erucic acid, isostearic acid, palmitic acid, oleic acid and linoleic acid. In preferred embodiments the carboxylic acid chain terminating group is a fatty carboxylic acid, and a particularly preferred fatty acid is oleic acid. A convenient and preferred source of oleic acid is tall oil fatty acid.

The polymeric organic friction modifier (b) suitably has an average molecular weight of from 1,000 to 30,000 Da, preferably from 1,500 to 25,000, more preferably from 2,000 to 20,000 Da.

The polymeric organic friction modifier (b) suitably has an acid value of less than 20, preferably less than 15 and more preferably less than 10. The polymeric organic friction modifier (b) suitably has an acid value of greater than 1, preferably greater than 3 and more preferably greater than 5. In a preferred embodiment, the friction modifier (BI) has an acid value in the range of 6 to 9.

Suitably, polymeric organic friction modifier (b) is as described in International Patent Application no WO 2011/107739.

In a preferred embodiment of all aspects of the invention, the polymeric organic friction modifier (b) is a reaction product of (i) maleated polyisobutylene (PIBSA), (ii) polyethylene glycol (PEG), (iii) glycerol and (iv) tall oil fatty acid. Preferably, the polyisobutylene of the maleated polyisobutylene has an average molecular weight of around 950 amu, and an approximate saponification value of 98 mg KOH/g. Preferably the PEG has a hydroxyl value of 190 mg KOH/g. A suitable product may be made by charging 110 g of maleated polyisobutylene, 72 g of PEG, 5 g of glycerol and 25 g of tall oil fatty acid into a glass round bottomed flask equipped with a mechanical stirrer, isomantle heater and overhead condenser. The reaction takes place in the presence of 0.1 g of esterification catalyst tetrabutyl titanate at 200-220° C. with removal of water to a final acid value of 10 mg KOH/g.

The polymeric organic friction modifier (b) of the present invention is preferably present in the lubricating oil composition in an amount between 0.1 and 3%, more preferably 0.1 and 1.5% by weight with respect to the weight of the lubricating oil composition.

Oil of Lubricating Viscosity

The oil of lubricating viscosity (sometimes referred to as "base stock" or "base oil") is the primary liquid constituent of a lubricant, into which additives and possibly other oils are blended, for example to produce a final lubricant (or lubricant composition). A base oil is useful for making concentrates as well as for making lubricating oil compositions therefrom, and may be selected from natural (vegetable, animal or mineral) and synthetic lubricating oils and mixtures thereof.

The base stock groups are defined in the American Petroleum Institute (API) publication "Engine Oil Licensing and Certification System", Industry Services Department, Fourteenth Edition, December 1996, Addendum 1, December 1998. Typically, the base stock will have a viscosity preferably of 3-12, more preferably 4-10, most preferably 4.5-8, mm is (cSt) at 100° C.

Definitions for the base stocks and base oils in this invention are the same as those found in the American Petroleum Institute (API) publication "Engine Oil Licensing and Certification System", Industry Services Department, Fourteenth Edition, December 1996, Addendum 1, December 1998. Said publication categorizes base stocks as follows:

a) Group 1 base stocks contain less than 90 percent saturates and/or greater than 0.03 percent sulphur and have a viscosity index greater than or equal to 80 and less than 120 using the test methods specified in Table E-1.
b) Group II base stocks contain greater than or equal to 90 percent saturates and less than or equal to 0.03 percent sulphur and have a viscosity index greater than or equal to 80 and less than 120 using the test methods specified in Table E-1.
c) Group III base stocks contain greater than or equal to 90 percent saturates and less than or equal to 0.03 percent sulphur and have a viscosity index greater than or equal to 120 using the test methods specified in Table E-1.
d) Group IV base stocks are polyalphaolefins (PAO).
e) Group V base stocks include all other base stocks not included in Group I, II, II, or IV.

TABLE E-1

Analytical Methods for Base Stock

| Property | Test Method |
|---|---|
| Saturates | ASTM D 2007 |
| Viscosity Index | ASTM D 2270 |
| Sulphur | ASTM D 2622 |
| | ASTM D 4294 |
| | ASTM D 4927 |
| | ASTM D 3120 |

Other oils of lubricating viscosity which may be included in the lubricating oil composition are detailed as follows:

Natural oils include animal and vegetable oils (e.g. castor and lard oil), liquid petroleum oils and hydrorefined, solvent-treated mineral lubricating oils of the paraffinic, naphthenic and mixed paraffinic-naphthenic types. Oils of lubricating viscosity derived from coal or shale are also useful base oils.

Synthetic lubricating oils include hydrocarbon oils such as polymerized and interpolymerized olefins (e.g. polybutylenes, polypropylenes, propylene-isobutylene copolymers, chlorinated polybutylenes, poly(1-hexenes), poly(1-octenes), poly(1-decenes)); alkylbenzenes (e.g. dodecylbenzenes, tetradecylbenzenes, dinonylbenzenes, di(2-ethylhexyl)benzenes); polyphenols (e.g. biphenyls, terphenyls, alkylated polyphenols); and alkylated diphenyl ethers and alkylated diphenyl sulfides and the derivatives, analogues and homologues thereof.

Another suitable class of synthetic lubricating oils comprises the esters of dicarboxylic acids (e.g. phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) with a variety of alcohols (e.g. butyl alcohol, hexyl alcohol, dodecyl alcohol, 2-ethylhexyl alcohol, ethylene glycol, diethylene glycol monoether, propylene glycol). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols, and polyol ethers such as neopentyl glycol, trimethylolpropane, pentaerythritol, dipentaerythritol and tripentaerythritol.

Unrefined, refined and re-refined oils can be used in the compositions of the present invention. Unrefined oils are those obtained directly from a natural or synthetic source without further purification treatment. For example, a shale oil obtained directly from retorting operations, a petroleum oil obtained directly from distillation or ester oil obtained directly from an esterification process and used without further treatment would be unrefined oil. Refined oils are similar to the unrefined oils except they have been further treated in one or more purification steps to improve one or more properties. Many such purification techniques, such as distillation, solvent extraction, acid or base extraction, filtration and percolation are known to those skilled in the art. Re-refined oils are obtained by processes similar to those used to obtain refined oils applied to refined oils which have been already used in service. Such re-refined oils are also known as reclaimed or reprocessed oils and often are additionally processed by techniques for approval of spent additive and oil breakdown products.

Other examples of base oil are gas-to-liquid ("GTL") base oils, i.e. the base oil may be an oil derived from Fischer-Tropsch synthesised hydrocarbons made from synthesis gas containing $H_2$ and CO using a Fischer-Tropsch catalyst. These hydrocarbons typically require further processing in order to be useful as a base oil. For example, they may, by methods known in the art, be hydroisomerized; hydrocracked and hydroisomerized; dewaxed; or hydroisomerized and dewaxed.

Whilst the composition of the base oil will depend upon the particular application of the lubricating oil composition and the oil formulator will chose the base oil to achieve desired performance characteristics at reasonable cost, the base oil of a lubricating oil composition according to the present invention typically comprises no more than 85 mass % Group IV base oil, the base oil may comprise no more than 70 mass % Group IV base oil, or even no more than 50 mass % Group IV base oil. The base oil of a lubricating oil composition according to the present invention may comprise 0 mass % Group IV base oil. Alternatively, the base oil of a lubricating oil composition according to the present invention may comprise at least 5 mass %, at least mass % or at least 20 mass % Group IV base oil. The base oil of a lubricating oil composition according to the present invention may comprise from 0 to 85 mass %, or from 5-85 mass %, alternatively from 10-85 mass % Group IV base oil.

Preferably, the volatility of the oil of lubricating viscosity or oil blend, as measured by the NOACK test (ASTM D5800), is less than or equal to 20%, preferably less than or equal to 16%, preferably less than or equal to 12%, more preferably less than or equal to 10%. Preferably, the viscosity index (VI) of the oil of lubricating viscosity is at least 95, preferably at least 110, more preferably up to 120, even more preferably at least 120, even more preferably at least 125, most preferably from about 130 to 140.

The oil of lubricating viscosity is provided in a major amount, in combination with a minor amount of additive components (a) and (b), as defined herein and, if necessary, one or more co-additives, such as described hereinafter, constituting a lubricating oil composition. This preparation may be accomplished by adding the additives directly to the oil or by adding them in the form of a concentrate thereof to disperse or dissolve the additive. Additives may be added to the oil by any method known to those skilled in the art, either before, at the same time as, or after addition of other additives.

Preferably, the oil of lubricating viscosity is present in an amount of greater than 55 mass %, more preferably greater than 60 mass %, even more preferably greater than 65 mass %, based on the total mass of the lubricating oil composition. Preferably, the oil of lubricating viscosity is present in an amount of less than 98 mass %, more preferably less than 95 mass %, even more preferably less than 90 mass %, based on the total mass of the lubricating oil composition.

When concentrates are used to make the lubricating oil compositions, they may for example be diluted with 3 to 100, e.g. 5 to 40, parts by mass of oil of lubricating viscosity per part by mass of the concentrate.

Preferably, the lubricating oil composition is a multigrade oil identified by the viscometric descriptor SAE 20WX, SAE 15WX, SAE 10WX, SAE 5WX or SAE 0WX, where X represents any one of 20, 30, 40 and 50; the characteristics of the different viscometric grades can be found in the SAE J300 classification. In an embodiment of each aspect of the invention, independently of the other embodiments, the lubricating oil composition is in the form of an SAE 10WX, SAE 5WX or SAE 0WX, preferably in the form of a SAE 5WX or SAE 0WX, wherein X represents any one of 20, 30, 40 and 50. Preferably X is 20 or 30.

The lubricating oil compositions useful in the present invention may also contain any of the conventional additives listed below (including any additional friction modifiers) which are typically used in a minor amount, e.g. such an amount so as to provide their normal attendant functions. Typical amounts for individual components are also set forth below. All the values listed are stated as mass percent active ingredient in the total lubricating oil composition.

| Additive | Mass % (Broad) | Mass % (Preferred) |
|---|---|---|
| Ashless dispersant | 0.1-20 | 1-8 |
| Metal detergents | 0.1-15 | 0.2-9 |
| Corrosion inhibitors | 0-5 | 0-1.5 |
| Metal dihydrocarbyl dithiophosphate | 0.1-6 | 0.1-4 |
| Anti-oxidant | 0-5 | 0.01-3 |
| Pour-point depressant | 0.01-5 | 0.01-1.5 |
| Anti-foaming agent | 0-5 | 0.001-0.15 |
| Supplemental anti-wear agents | 0-5 | 0-2 |
| Additional friction modifier | 0-5 | 0-1.5 |
| Viscosity modifier | 0-6 | 0.01-4 |

The individual additives may be incorporated into a basestock in any convenient PG, way. Thus, each of the components can be added directly to the basestock by dispersing or dissolving it in the basestock at the desired level of concentration. Such blending may occur at ambient temperature or at an elevated temperature.

Preferably, all the additives except for the viscosity modifier and the pour point depressant are blended into a concentrate (or additive package) that is subsequently blended into basestock to make a finished lubricating oil composition. Use of such concentrates is conventional. The concentrate will typically be formulated to contain the additive(s) in proper amounts to provide the desired concentration in the final lubricating oil composition when the concentrate is combined with a predetermined amount of base oil.

The concentrate is conveniently made in accordance with the method described in U.S. Pat. No. 4,938,880. That patent describes making a pre-mix of ashless dispersant and metal detergents that is pre-blended at a temperature of at least about 200° C. Thereafter, the pre-mix is cooled to at least 85° C. and the additional components are added.

The final crankcase lubricating oil composition may employ from 2 to 20 mass % and preferably 4 to 15 mass % of the concentrate (or additive package), the remainder being base oil.

Ashless dispersants maintain in suspension oil-insoluble matter resulting from oxidation of the oil during wear or combustion. They are particularly advantageous for preventing precipitation of sludge and formation of varnish, particularly in gasoline engines.

Ashless dispersants comprise an oil-soluble polymeric hydrocarbon backbone bearing one or more functional groups that are capable of associating with particles to be dispersed. Typically, the polymer backbone is functionalized by amine, alcohol, amide, or ester polar moieties, often via a bridging group. The ashless dispersant may be, for example, selected from oil-soluble salts, esters, amino-esters, amides, imides, and oxazolines of long chain hydrocarbon substituted mono and dicarboxylic acids or their anhydrides; thiocarboxylate derivatives of long chain hydrocarbons; long chain aliphatic hydrocarbons having a polyamine attached directly thereto; and Mannich condensation products formed by condensing a long chain substituted phenol with formaldehyde and polyalkylene polyamine.

The oil-soluble polymeric hydrocarbon backbone of these dispersants is typically derived from an olefin polymer or polyene, especially polymers comprising a major molar amount (i.e. greater than 50 mole %) of a $C_2$ to $C_{18}$ olefin (e.g. ethylene, propylene, butylene, isobutylene, pentene, octene-1, styrene), and typically a $C_2$ to $C_5$ olefin. The oil-soluble polymeric hydrocarbon backbone may be a homopolymer (e.g. polypropylene or polyisobutylene) or a copolymer of two or more of such olefins (e.g. copolymers of ethylene and an alpha-olefin such as propylene or butylene, or copolymers of two different alpha-olefins). Other copolymers include those in which a minor molar amount of the copolymer monomers, for example, 1 to 10 mole %, is an $\alpha,\omega$-diene, such as a $C_3$ to $C_{22}$ non-conjugated diolefin (for example, a copolymer of isobutylene and butadiene, or a copolymer of ethylene, propylene and 1,4-hexadiene or 5-ethylidene-2-norbornene). Preferred are polyisobutenyl (Mn 400-2500, preferably 950-2200) succinimide dispersants.

The viscosity modifier (VM) functions to impart high and low temperature operability to a lubricating oil composition. The VM used may have that sole function, or may be multifunctional.

Multifunctional viscosity modifiers that also function as dispersants are also known. Suitable viscosity modifiers are polyisobutylene, copolymers of ethylene and propylene and higher alpha-olefins, polymethacrylates, polyalkylmethacrylates, methacrylate copolymers, copolymers of an unsaturated dicarboxylic acid and a vinyl compound, inter polymers of styrene and acrylic ester, and partially hydrogenated copolymers of styrene/isoprene, styrene/butadiene, and isoprene/butadiene, as well as the partially hydrogenated homopolymers of butadiene and isoprene and isoprene/divinylbenzene.

Metal-containing or ash-forming detergents may be present and these function both as detergents to reduce or remove deposits and as acid neutralizers or rust inhibitors, thereby reducing wear and corrosion and extending engine life. Detergents generally comprise a polar head with a long hydrophobic tail, the polar head comprising a metal salt of an acid organic compound. The salts may contain a substantially stoichiometric amount of the metal in which they are usually described as normal or neutral salts, and would typically have a total base number (TBN), as may be measured by ASTM D-2896 of from 0 to 80. It is possible to include large amounts of a metal base by reacting an excess of a metal compound such as an oxide or hydroxide with an acid gas such as carbon dioxide. The resulting overbased detergent comprises neutralized detergent as the outer layer of a metal base (e.g. carbonate) micelle. Such overbased detergents may have a TBN of 150 or greater, and typically from 250 to 450 or more. Detergents that may be used include oil-soluble neutral and overbased sulfonates, phenates, sulfurized phenates, thiophosphonates, salicylates, and naphthenates and other oil-soluble carboxylates of a metal, particularly the alkali, e.g. sodium, potassium, lithium and magnesium. Preferred are neutral or overbased calcium and magnesium phenates and sulfonates, especially calcium.

Other friction modifiers include oil-soluble amines, amides, imidazolines, amine oxides, amidoamines, nitriles, alkanolamides, alkoxylated amines and ether amines; polyol esters; and esters of polycarboxylic acids.

Dihydrocarbyl dithiophosphate metal salts are frequently used as anti-wear and antioxidant agents. The metal may be an alkali or alkaline earth metal, or aluminum, lead, tin, molybdenum, manganese, nickel or copper. They may be prepared in accordance with known techniques by first forming a dihydrocarbyl dithiophosphoric acid (DDPA), usually by reaction of one or more alcohol or a phenol with $P_2S_5$ and then neutralizing the formed DDPA with a zinc compound. For example, a dithiophosphoric acid may be made by reacting mixtures of primary and secondary alcohols. Alternatively, multiple dithiophosphoric acids can be prepared where the hydrocarbyl groups on one are entirely secondary in character and the hydrocarbyl groups on the others are entirely primary in character. To make the zinc salt, any basic or neutral zinc compound may be used but oxides, hydroxides and carbonates are most generally employed. Commercial additives frequently contain an excess of zinc due to use of an excess of the basic zinc compound in the neutralization reaction.

ZDDP provides excellent wear protection at a comparatively low cost and also functions as an antioxidant. However, there is some evidence that phosphorus in lubricant can shorten the effective life of automotive emission catalysts. Accordingly, the lubricating oil compositions of the invention preferably contain no more than 0.8 wt %, such as from 50 ppm to 0.06 wt %, of phosphorus. Independently of the amount of phosphorus, the lubricating oil composition preferably has no more than 0.5 wt %, preferably from 50 ppm to 0.3 wt %, of sulfur, the amounts of sulfur and of phosphorus being measured in accordance with ASTM D5185.

Oxidation inhibitors or antioxidants reduce the tendency of basestocks to deteriorate in service, which deterioration can be evidenced by the products of oxidation such as sludge and varnish-like deposits on the metal surfaces and by viscosity growth. Such oxidation inhibitors include hindered phenols, alkaline earth metal salts of alkylphenolthioesters having preferably $C_5$ to $C_{12}$ alkyl side chains, calcium nonylphenol sulfide, ashless oil-soluble phenates and sulfurized phenates, phosphosulfurized or sulfurized hydrocarbons, phosphorous esters, metal thiocarbamates, oil-soluble copper compound as described in U.S. Pat. No. 4,867,890, and molybdenum-containing compounds.

Rust inhibitors selected from the group consisting of nonionic polyoxyalkylene polyols and esters thereof, polyoxyalkylene phenols, and anionic alkyl sulfonic acids may be used.

Copper- and lead-bearing corrosion inhibitors may be used, but are typically not required in the lubricating oil compositions of the present invention. Typically such compounds are thiadiazole polysulfides containing from 5 to 50 carbon atoms, their derivatives and polymers thereof. Derivatives of 1,3,4-thiadiazoles, such as those described in U.S. Pat. Nos. 2,719,125; 2,719,126; and 3,087,932, are typical. Other similar material are described in U.S. Pat. Nos. 3,821,236; 3,904,537; 4,097,387; 4,107,059; 4,136,043; 4,188,299; and 4,193,882. Other additives are thio and polythio sulfenamides of thiadiazoles such as those described in GB-A-1,560,830. Benzotriazoles derivatives also fall within this class of additive. When these compounds are included in the lubricating oil compositions, they are preferably present in an amount not exceeding 0.2 wt % active ingredient.

A small amount of a demulsifying component may be used. A preferred demulsifying component is described in EP-A-330 522. It is obtained by reacting an alkylene oxide with an adduct obtained by reacting a bis-epoxide with a polyhydric alcohol. The demulsifier should be used at a level not exceeding 0.1 mass % active ingredient. A treat rate of 0.001 to 0.05 mass % active ingredient is convenient.

Pour point depressants, otherwise known as lube oil improvers, lower the minimum temperature at which the fluid will flow or can be poured. Such additives are well-known. Typical of those additives, which improve the low temperature fluidity of the fluid, are $C_8$ and $C_{18}$ dialkyl fumarate/vinyl acetate copolymers and polyalkylmethacrylates.

Foam control can be provided by many compounds including an antifoamant of the polysiloxane type, for example, silicone oil or polydimethyl siloxane.

In this specification, the term "comprising" (or cognates such as "comprises") means the presence of stated features, integers, steps or components, but does not preclude the presence or addition of one or more other features, integers, steps, components or groups thereof. If the term "comprising" (or cognates) is used herein, the term "consisting essentially of" (and its cognates) is within its scope and is a preferred embodiment; consequently the term "consisting of" (and its cognates) is within the scope of "consisting essentially of" and is a preferred embodiment thereof.

The terms "oil-soluble" or "oil-dispersible" do not mean that the compounds are soluble, dissolvable, miscible or capable of being suspended in the oil in all proportions. They do mean, however, that the compounds are, for instance, soluble or stably dispersible in the oil to an extent sufficient to exert their intended effect in the environment in which the composition is employed. Moreover, the additional incorporation of other additives such as those described above may affect the solubility or dispersibility of the compounds.

The term "major amount" means in excess of 50 mass % of the composition.

The term "minor amount" means less than 50 mass % of the composition.

The invention is further illustrated by the following examples which are not to be considered as limitative of its scope. All percentages are by weight active ingredient content of an additive without regard for carrier or diluent oil.

EXAMPLES

A base lubricating oil composition was prepared. The base oil contained a succinimide dispersant, a calcium sulphonate detergent, zinc dialkyldithiophosphate (ZDDP), a combination of anti-oxidants comprising a hindered phenol, a diphenylamine and a sulphurised ester, a silicon-containing antifoamant, a pour point depressant and a viscosity modifier. These components were blended into an API Group II base-stock to produce the base lubricating oil composition.

Test oils were then prepared. One test oil comprised the base lubricating oil as prepared above without further components added and seven test oils were prepared by adding additional components to the base lubricating oil. Details of the test oils are given in the table below where the concentration of molybdenum in the test oil is expressed in parts per million (ppm) by weight, relative to the weight of the test oil as measured by ASTM D5185, and the amount of friction modifier added is given in weight %, again relative to weight of the test oil:

| Test Oil | Added component(s) | [Mo] in oil/ ppm | Friction modifier/ wt % |
|---|---|---|---|
| 1(c) | None | 0 | 0 |
| 2(c) | Tri-nuclear molybdenum dithiocarbamate | 600 | 0 |
| 3(c) | Mixture of di-nuclear molybdenum dithiocarbamate and tri-nuclear molybdenum dithiocarbamate | 600 | 0 |
| 4(c) | Polymeric organic friction modifier | 0 | 1 |
| 5(c) | Glycerol mono-oleate friction modifier | 0 | 1 |
| 6(c) | Mixture of di-nuclear molybdenum dithiocarbamate and tri-nuclear molybdenum dithiocarbamate + glycerol mono-oleate friction modifier | 600 | 1 |
| 7 | Tri-nuclear molybdenum dithiocarbamate + polymeric organic friction modifier | 600 | 1 |
| 8 | Mixture of di-nuclear molybdenum dithiocarbamate and tri-nuclear molybdenum dithiocarbamate + polymeric organic friction modifier | 600 (300 from each Mo compound) | 1 |
| 9 | Di-nuclear molybdenum dithiocarbamate + polymeric organic friction modifier | 600 | 1 |
| 10(c) | Tri-nuclear molybdenum dithiocarbamate | 300 | 0 |
| 11 | Tri-nuclear molybdenum dithiocarbamate + polymeric organic friction modifier | 300 | 1 |

(c)comparative example

Oils 1 to 6 and 10 are comparative examples and oils 7, 8, 9 and 11 are examples in accordance with the present invention. The polymeric organic friction modifier used was the reaction product of (i) maleated polyisobutylene (PIBSA) where the polyisobutylene group had an average molecular weight of around 950 amu, and an approximate saponification value of 98 mg KOH/g (ii) polyethylene glycol (PEG) having a hydroxyl value of 190 mg KOH/g, (iii) glycerol and (iv) tall oil fatty acid. It was prepared as described hereinabove. Glycerol mono-oleate was chosen as it is a conventional friction modifier commonly used in lubricating oil compositions.

Each oil was tested using a Mini-Traction Machine with reciprocating function (MTM-R) available from PCS Instruments, London, UK. This machine employs a inch (19 mm) diameter ball as an upper specimen which is reciprocated under an applied load against a lower specimen in the form of a disc. The ball was made from AISI52100 grade steel and was uncoated. The disc was made of steel which had been coated with DLC (Balinit® DLC-Star: a-C:H type)) to a depth of around 2 μm. The contact between the ball and the disc was thus between a ferrous (steel) surface and a surface coated with a diamond-like carbon coating. The test conditions are given in the table below:

| | |
|---|---|
| Oil temperature | 100° C. |
| Disc frequency | 10 Hz |
| Ball speed | 200 $mms^{-1}$ |
| Stroke length | 4000 μm |
| Applied load | 50 N |
| Contact pressure | 1.2 GPa |
| Test duration | 2 hours |

The wear scars formed on the lower disc specimens (DLC coated) were analysed using a Zemetrics ZeScope 3D optical profilometer using non-contact interferometric focal scanning. This permitted a measurement of the amount of wear by determining the material lost from the disc during the test. This was reported as a wear scar volume (WSV) in units of $\mu m^3$. Additionally, the co-efficient of friction of the contact was recorded at the end of each test. Results are shown in the table below where each value is the average of two tests using each test oil.

| Test Oil | WSV/$\mu m^3$ | Friction co-efficient |
|---|---|---|
| 1(c) | 40755 | 0.1069 |
| 2(c) | 143390 | 0.0633 |
| 3(c) | 93563 | 0.0462 |
| 4(c) | 22682 | 0.1021 |
| 5(c) | 13034 | 0.0929 |
| 6(c) | 70145 | 0.0476 |
| 7 | 59222 | 0.0769 |
| 8 | 13430 | 0.0783 |
| 9 | 37810 | 0.0885 |
| 10(c) | 85133 | 0.0665 |
| 11 | 42396 | 0.0510 |

(c)comparative example

By comparing Oils 1, 2, 3 and 10 it can be seen clearly that the presence of the molybdenum compound alone leads to significantly increased wear on the DLC surface. This confirms the observations reported by I Sugimoto referred to above in, *Transactions of the Japan Society of Mechanical Engineers, Series A*, Vol. 78, No. 786, pp. 213-222. The friction modifiers alone, either the polymeric organic friction modifier (b) or the conventional glycerol mono-oleate friction modifier, were effective to reduce wear on the DLC surface but did not provide any significant reduction in friction co-efficient (compare Oil 1 with Oils 4 and 5). The combination of molybdenum compounds with the conventional glycerol mono-oleate friction modifier provided good friction performance but poor wear protection (compare Oil 1 with Oil 6). Contrastingly, the examples according to the invention (using Oil 7, Oil 8 and Oil 9) provided both good wear protection and low friction co-efficients. Oil 7 differs from Oil 2 only in the presence of the polymeric organic friction modifier (b) but this leads to a nearly 60% fall in recorded WSV while maintaining a low friction co-efficient. Similarly, Oil 8 differs from Oil 3 only in the presence of the polymeric organic friction modifier (b) but this leads to an 85% fall in recorded WSV while maintaining a low friction co-efficient. Oil 9 also showed good wear protection and a low friction co-efficient Oil 10 shows that a lower amount of molybdenum compound alone also leads to a significant increase in wear (c.f. Oil 1). Addition of the polymeric organic friction modifier (b) restores the wear protection while also providing a low co-efficient of friction (Oil 11).

The results show that the combination of a molybdenum compound with the particular type of polymeric organic friction modifier (b), in accordance with the present invention, is able to provide a lubricating oil which when used to lubricate the contact between a DLC surface and a ferrous (steel) surface, protects the DLC surface from wear while also maintaining a low friction contact. This behaviour is not seen with a common type of friction modifier. The combination of a di-nuclear molybdenum compound and a tri-nuclear molybdenum compound (Oil 8) provided the best overall performance in terms of good wear protection and low friction co-efficient. The present invention thus enables the lubricant formulator to exploit the beneficial properties provided by molybdenum compounds in systems where DLC surfaces are in contact with ferrous surfaces.

Further test oils were prepared using a base lubricating oil containing a succinimide dispersant, a calcium sulphonate detergent, zinc dialkyldithiophosphate (ZDDP), a combination of anti-oxidants comprising a hindered phenol, a diphenylamine and a sulphurised ester, a silicon-containing anti-foamant, a pour point depressant and a viscosity modifier. As above, the base-stock used was an API Group II base-stock. The table below details the test oils.

| Test Oil | Added component(s) | [Mo] in oil/ ppm | Friction modifier/ wt % |
|---|---|---|---|
| 12(c) | None | 0 | 0 |
| 13(c) | Tri-nuclear molybdenum dithiocarbamate | 600 | 0 |
| 14(c) | Tri-nuclear molybdenum dithiocarbamate + Perfad ™ 3006 | 600 | 1 |

(c)comparative example

It is believed that Perfad™ 3006 is polymeric organic friction modifier formed from the reaction of sorbitol, ethylene oxide and poly (12-hydroxystearic acid) as described in WO 2015/065801. Perfad™ 3006 is thus chemically distinct from the polymeric organic friction modifier used in the present invention. MTM-R testing as described above was carried out on Test Oils 12-14 giving the following results.

| Test Oil | WSV/$\mu m^3$ | Friction co-efficient |
|---|---|---|
| 12(c) | 47173 | 0.0896 |
| 13(c) | 133155 | 0.0580 |
| 14(c) | 99559 | 0.0509 |

As before, the presence of the molybdenum compound alone lead to significantly increased wear on the DLC surface (compare Oils 12 and 13). However, although the combination of Perfad™ 3006 and the molybdenum compound gave good friction performance, the wear protection afforded to the DLC surface was much less pronounced. Comparing Oils 13 and 14 shows that with respect to the presence of the molybdenum compound alone, the additional presence of Perfad™ 3006 gave only a 25% reduction in WSV. This can be contrasted with the results for Oils 2 and 7 where the presence of the polymeric organic friction modifier gave a 60% reduction in WSV. It is thus clear that the polymeric organic friction modifiers used in the present invention are significantly more effective at preventing wear in a steel-DLC contact than is Perfad™ 3006.

What is claimed is:

1. A method of lubricating the frictional contact between a first surface coated with a hydrogenous carbon film or coating of type a-C:H, ta-C:H, a-C:H:Me or a-C:H:X, as classified by VDI-Standard VDI 2840; and a second, ferrous surface, which method comprises supplying to said frictional contact a lubricating oil composition comprising a major amount of an oil of lubricating viscosity and (a) an oil-soluble or oil-dispersible molybdenum compound in an amount such as to provide between 150 and 1000 ppm by weight of molybdenum to the lubricating, oil composition, and (b) between 0.1 and 5% by weight with respect to the weight of the lubricating oil composition of a polymeric organic friction modifier, the organic friction modifier being a reaction product of (i) a functionalised polyolefin, (ii) a polyether, (iii) a polyol and (iv) a monocarboxylic acid chain terminating group.

2. The method of claim 1 wherein the oil-soluble molybdenum compound (a) is present in an amount to provide between 300 and 1000 ppm by weight of molybdenum to the lubricating oil composition.

3. The method of claim 1 wherein the oil-soluble molybdenum compound (a) comprises one or more molybdenum dithiocarbamates.

4. The method of claim 3 wherein the oil-soluble molybdenum compound (a) comprises one or more di-nuclear molybdenum dithiocarbamates or one or more tri nuclear molybdenum dithiocarbamates.

5. The method of claim 4 wherein the oil-soluble molybdenum compound (a) comprises a mixture of one or more di-nuclear molybdenum compounds and one or more tri-nuclear molybdenum compounds.

6. The method of claim 1 wherein the functionalised polyolefin (i) is derived from a polymer of a mono-olefin having from 2 to 6 carbon atoms.

7. The method of claim 1 wherein the functionalised polyolefin (i) comprises a diacid or anhydride functional group from reaction of the polyolefin with an unsaturated diacid or anhydride.

8. The method of claim 1 wherein the functionalised polyolefin (i) is a polyisobutylene polymer that has been reacted with maleic anhydride to form polyisobutylene succinic anhydride (PIBSA).

9. The method of claim 1 wherein the polyether (ii) comprises a polyglycerol or a polyalkylene glycol.

10. The method of claim 1 wherein the polyether (ii) comprises a polyethylene glycol (PEG), a mixed poly(ethylene-propylene) glycol or a mixed polyethylene-butylene) glycol.

11. The method of claim 1 wherein the polyol (iii) comprises a diol, triol, tetraol or related dimers, trimers or larger oligomers of such compounds.

12. The method of claim 1 wherein the polyol (iii) comprises one or more of glycerol, neopentyl glycol, trimethylolethane, trimethylolpropane, trimethylolbutane, pentaerythritol, dipentaerythritol, tripentaerythritol and sorbitol.

13. The method of claim 1 wherein the carboxylic acid (iv) comprises a $C_2$-$C_{36}$ carboxylic acid, which acid is linear or branched, saturated or unsaturated.

14. The method of claim 1 wherein the carboxylic acid (iv) comprises one or more of lauric acid, erucic acid, isostearic acid, palmitic acid, oleic acid and linoleic acid.

15. The method of claim 1 wherein the polymeric friction modifier (b) comprises the reaction product of (i) maleated polyisobutylene (PIBSA), (ii) polyethylene glycol (PEG), (iii) glycerol and (iv) tall oil fatty acid.

16. The method of claim 1 wherein the polymeric friction modifier (b) is present in the lubricating oil composition in an amount of between 0.1 and 3% by weight with respect to the weight of the lubricating oil composition.

17. The method of claim 1 wherein the lubricating oil composition further comprises one or more additional additives selected from the group consisting of ashless dispersants, metal detergents, corrosion inhibitors, metal dihydrocarbyl dithiophosphates, antioxidants, pour point depressants, anti-foaming agents, additional friction modifiers, antiwear agents and viscosity modifiers.

18. An internal combustion engine having one or more component parts coated with a hydrogenous carbon film or coating of type a-C:1-1, ta-C:H, a-C:H:Me or a-C:H:X, as classified by VDI-Standard VDI 2840, which parts during operation of the engine, are in frictional contact with a ferrous surface and, contained in a reservoir in the engine, a lubricating oil composition comprising a major amount of an oil of lubricating viscosity and (a) an oil-soluble or oil-dispersible molybdenum compound in an amount such as to provide between 150 and 1000 ppm by weight of molybdenum to the lubricating oil composition, and (b) between 0.1 and 5% by weight with respect to the weight of the lubricating oil composition of a polymeric organic friction modifier, the organic friction modifier being a reaction product of (i) a functionalised polyolefin, (ii) a polyether, (iii) a polyol and (iv) a monocarboxylic acid chain terminating group.

19. The internal combustion engine of claim 18 wherein the lubricating oil composition further comprises one or more additional additives selected from the group consisting of ashless dispersants, metal detergents, corrosion inhibitors, metal dihydrocarbyl dithiophosphates, antioxidants, pour point depressants, anti-foaming agents, additional friction modifiers, antiwear agents and viscosity modifiers.

20. The method of claim 1, wherein the ferrous surface is a steel surface.

21. The internal combustion engine of claim 18 wherein the ferrous surface is a steel surface.

22. The method of claim 20, wherein the steel surface is present in the cam shaft, pistons, cylinder liners and/or valves.

23. The internal combustion engine of claim 21, wherein the steel surface is present in the cam shaft, pistons, cylinder liners and/or valves.

* * * * *